US005244208A

United States Patent [19]

Kalapacs et al.

[11] Patent Number: 5,244,208

[45] Date of Patent: Sep. 14, 1993

[54] LOGICAL MOSAIC-PUZZLE

[76] Inventors: Janos Kalapacs, Csokonai u. 10. fsz. 2, Budapest, Hungary, H-1081; Mihail I. Lobak, Kornyejcsuka sgt. 39. flat 25, Kiev, U.S.S.R.

[21] Appl. No.: 842,105

[22] PCT Filed: Sep. 19, 1990

[86] PCT No.: PCT/HU90/00066

§ 371 Date: May 13, 1992

§ 102(e) Date: May 13, 1992

[30] Foreign Application Priority Data

Sep. 20, 1989 [HU] Hungary ..... 4898/89

[51] Int. Cl.[5] ..... A63F 9/08

[52] U.S. Cl. ..... 273/153 S; 273/155

[58] Field of Search ..... 273/153 S, 155, 157 R

[56] References Cited

U.S. PATENT DOCUMENTS 4,415,158 11/1983 Engel ..... 273/155
4,550,040 10/1985 Fisher ..... 273/153 X
4,580,783 4/1986 Cohan ..... 273/155
4,978,126 12/1990 Morosow et al. ..... 273/155

FOREIGN PATENT DOCUMENTS

A12490102 3/1982 France .
A22489164 3/1982 France .
2117256 10/1983 United Kingdom ..... 273/155
2199755 7/1988 United Kingdom ..... 273/155
9006793 6/1990 World Int. Prop. O. ..... 273/155

OTHER PUBLICATIONS

Toys International and the Retailer, "Rotoscope," Feb. 1983, p.34.

*Primary Examiner*—V. Millin
*Assistant Examiner*—Steven B. Wong
*Attorney, Agent, or Firm*—Pennie & Edmonds

[57] ABSTRACT

The intention of the present invention is realized by a logical mosaic-puzzle, which is built-up of a given number of elements, where between the two main elements, the casing and the clamping frame there are mosaic toy-elements connected to each other loosely. The toy-elements are formed in such a manner that they can be turned on circles extending into or overlapping each other, about the axis of the circles and simultaneously compared to the other circles. Moreover the circles each consist of 6 toy-elements, out of which one toy-element forms the part of three different circles while the other circles are also formed of 6 toy-elements each, which can be ranged into two different groups, and which toy-elements are provided with projections joining each other, the casing and the clamping-frame; and with grooves taking up these projections. The number of the toy-elements can 13, 16 or 19.

16 Claims, 6 Drawing Sheets

LOGICAL MOSAIC-PUZZLE

TECHNICAL FIELD

The invention relates to a logical mosaic-puzzle containing mosaic toy-elements forming three different groups. In its built-up form the toy is arranged in circles extending into one another and situated in a frame consisting of two elements and casing and clamping-frame.

BACKGROUND ART

The most general well-known types of the mosaic puzzles are based on an arrangement, with which different elements or plates are to be fitted to each other with the aim to produce some pre-determined shape and configuration respectively.

Mosaic-puzzles, with which the elements are starting from a given place have been considered with novelties, as the place of one element left empty, whereby the desired formation or configuration can be obtained by shifting or displacing the puzzle-elements. The elements typically have been provided with colours, numbers or other markings. Even at present a small number of planar toys or toys with a planar effect are known, with which motion of the elements is solved in a different way, e.g. by the transformation of spatial possibilities into the plane by means of balls, gears and pins, the elements are slid into one another. Far fewer is the number of toys, with which simultaneously several elements can be put into motion.

The invention relates to a logical mosaic-puzzle with a planar effect, with which a plurality of the elements of the toy can be turned simultaneously to form the desired configurations. By mixing up of the elements several variations may be obtained.

By virtue of shape and easy manipulation, the toy according to the invention is well suitable for the development of logical and combinative abilities. For turning the toy-elements several logical mosaic-puzzles are known. Similar solutions are specificed in the PS-SU-1238773, GB-PS 2199 755 and GB-PS 2 117 256. The shape of the elements, the mode of fitting, the configurations to be obtained, accordingly the general impression are differing from one another and from the solution according to the invention. The disadvantage of all said solutions lies in that construction and facilitating of manipulation have been solved to the detriment of playing.

The toy according to the invention can be compared mostly to the principle that can be learned from the patent descriptions no. FR,A2, 2489 164 and FR A1, 2490 102. The basis of the above patent descriptions is the recognition known from the special literature of projective geometry, according to which three circular plates of proper thickness, extending into one another, sliced into curved puzzle-plates can be rotated in respect to each other, thereby mosaic-puzzle plates get mixed up.

The disadvantage of the above patents is that their formation does not allow—because of the spatial sweep—that the elements be extended in a secure, playable manner. A further disadvantage is that the toys according to the above priority patents can be produced in series only over a given size-limit. Due to the extreme size of the toy and the permanent risk of its falling into pieces the play cannot be suitably enjoyed.

SUMMARY OF THE INVENTION

The aim of the present invention is the realization of such a formation, which enables the increase of the number of the mosaic plates and by this the increase of the possible variations, by which a more exciting and more interesting toy can be formed. Moreover it enables the production of the toy in the desired size and makes enjoyable the use of the toy. Consequently, the toy according to the present invention differs in its structure and general impression from the patents mentioned above.

The intention of the invention is realized by such a logical mosaic-puzzle, which is built-up of a given number of elements, where between the two main elements, the casing and the clamping frame there are mosaic toy-elements connected to each other loosely. The toy-elements are formed in such a manner that they can be turned on circles extending into or overlapping each other, about the axis of the circles and simultaneously compared to the other circles. Moreover the circles each consist of 6 toy-elements, out of which one toy-element forms the part of three different circles while the other circles are also formed of 6 toy-elements each, which can be ranged into two different groups, and which toy-elements are provided with projections joining each other, the casing and the clamping-framce; and with the grooves taking up these projections. The number of the toy-elements can be 13, 16 or 19.

In a suitable embodiment of the logical mosaic-puzzle of the invention the only toy-element forming the three circles is essentially a prism having the form of a regular arch-triangle surrounded by lateral arches, on each three sides of which a projection is formed.

In another suitable embodiment of the logical mosaic-puzzle of the invention, the toy-element that can be ranged into the second group of elements joins the toy-element having the form of an arch-triangle and also takes part in the formation of the further circles. This element is a shape having the form of a prism, surrounded with two convex arch-sides, and concave arch-side joining these convex arch-sides, the convex arch-sides of the prism are provided each with a projection joining the neighbouring toy-elements, as well as with a groove taking up the projections of the connecting toy-elements. The number of the elements that can be ranged into the second group can be 9, 11 or 13.

In case of another suitable embodiment of the logical mosaic-puzzle of the invention, the toy-element joining the toy-elements ranged into the second group, that fills up the free parts of the casing and of the clamping-frame and takes part in the formation of the circles, forming the third group of the toy-elements is a prism having two concave arch-sides and convex arch-sides joining these arch-sides, the convex arch-sides of the prism are provided each with a projection joining the suitable part of the casing and the clamping-frame while the concave arch-sides are provided each with grooves taking up the projections of the joining elements. The number of the elements that can be ranged into the third group is equal to the number of the circles intersecting each other i.e. three, four or five.

In case of all suitable embodiments of the logical mosaic-puzzle of the invention, the visible surfaces of the toy-elements are provided with distinguishing colours or other markings, and the turning of the different toy-elements included in the casing and the clamping-frame of the circles formed of the arch-sides of the toy-elements can take place simultaneously from two sides of the space only. As a consequence the planar characteristics of the toy change it into a solid.

BRIEF DESCRIPTION OF THE DRAWINGS

A preferred embodiment of the invention will be described by way of example in details and with reference to the accompanying drawings, in which:

The logical mosaic-puzzle as per FIG. 1 is built-up of 15 elements, which can essentially be divided into two main elements, a casing (1) and a clamping-frame (2) as well as the 13 pieces of moveable toy-elements (3, 4, 5) surrounded by the casing (1) and the clamping-frame (2). The puzzle-elements (3, 4 and 5) can be ranged into three different groups, however in a group the toy-elements have the same shaping. The first group consists only of one element, element No. (3) which is also part of three intersecting circles. This toy-element (3) is essentially a prism having the base of a regular arch-triangle surrounded by lateral arches (12), on each three sides of which a projection (11) can be found in order to assure the connection with the neighbouring puzzle-elements (4). (See 6 and 7).

Figure 8:
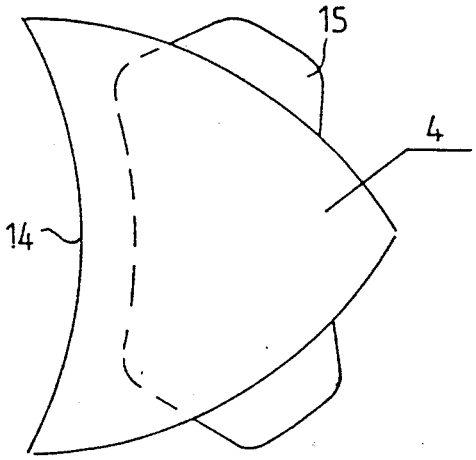
FIG. 8 is the top view of the puzzle-element ranged into the second group of the logical mosaic-puzzle as per FIG. 1.
Figure 9:
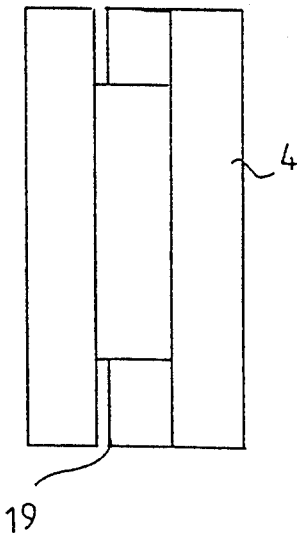
FIG. 9 is the side-view of the puzzle-element as per FIG. 8.

The toy-elements (4) belong to the second group, which join on the one hand the puzzle-elements (3) and on the other hand the toy-elements (5) and the total number of the toy elements (4) is 9. The toy-elements (4) have the form of a prism, surrounded with two convex arch-sides, (13) and a concave arch-side (14) joining these convex arch-sides, the convex arch-sides (13) of the prism are provided with projections (15) joining the toy-element (5), while the concave arch-sides (14) are provided with grooves (19) taking up the projections (11) and (15) of the connecting toy-elements (3) and (4) (see FIGS. 8 and 9).

Figure 10:
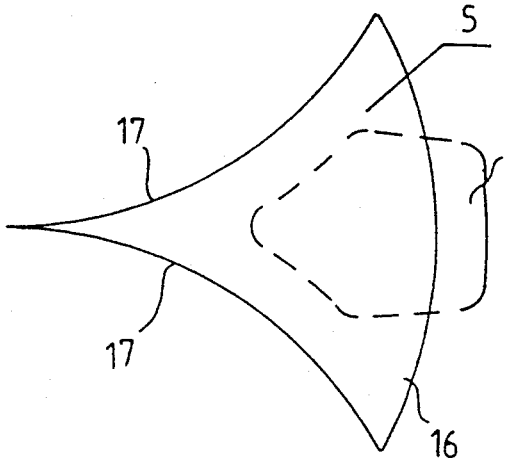
FIG. 10 is the top view of a further puzzle-element of the logical mosaic-puzzle shown on FIG. 1.
Figure 11:
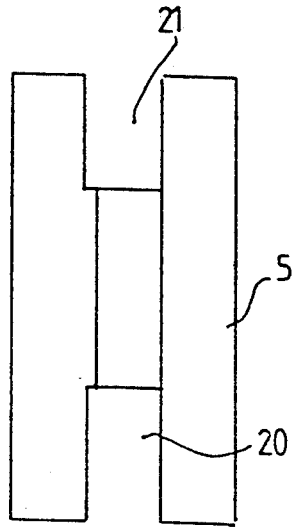
FIG. 11 is the side view of the puzzle-element as per FIG. 10.

Finally, to the third group belong (3 pieces) the toy-elements (5) assuring the formation of the three circles, which toy-element (5) is connected to the puzzle-elements (4) and fills the free parts of the casing (1) and the clamping-frame (2). The toy-elements (5) of the group have the form of a prism having two concave arch-sides (17) and a convex arch-side (16) which is provided with a projection (18) joining the suitable part of the casing (1) and the clamping-frame (2) while the concave arch-sides (17) are provided each with grooves (20) and (21) taking up the projections (15) of the joining elements (4). (See FIGS. 10 and 11.)

When assembling the logical mosaic-puzzle of the invention the toy-elements (3), (4) and (5)—the projections (11) (15) and (18) and the groove (19), (20) and (21) are fitted into each other and placed into the casing (1) so as to form three circles extending parts symmetrically into each other.

When inserting the clamping frame (2) essentially a groove will be formed between the casing (1) and the clamping frame (2) which consist of curved parts. All the grooves and projections of the puzzle are fitting accurately, however loosely. In such a manner it becomes possible that in any position six elements each of one, two or all the three circles could be turned in respect to the other elements independently, by means of two fingers. In accordance with the aim set, from turn to turn we can change the position of the puzzle-elements (3), (4) and (5), one element (3), (4) and (5) each may be transferred from one circle to the other, then to the third, fifth one and back etc. The sense of the game becomes obvious, if visible surfaces of the elements (3), (4) and (5) are provided with distinguishing markings, such as colour or other signs.

Figure 1:
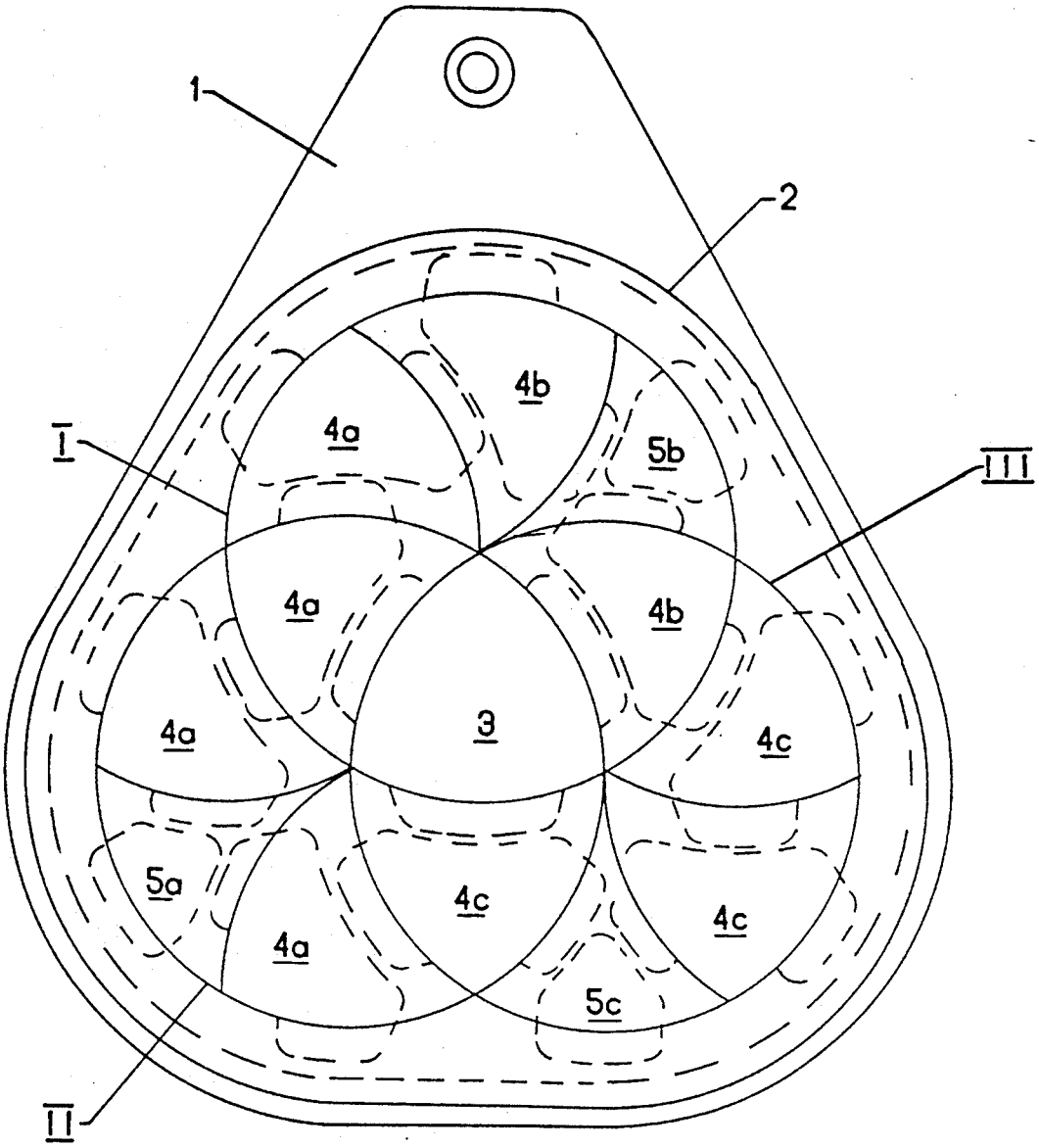
FIG. 1 is the top view of the embodiment with three circles of the logical mosaic-puzzle in accordance with the invention, in assembled state.
Figure 2:
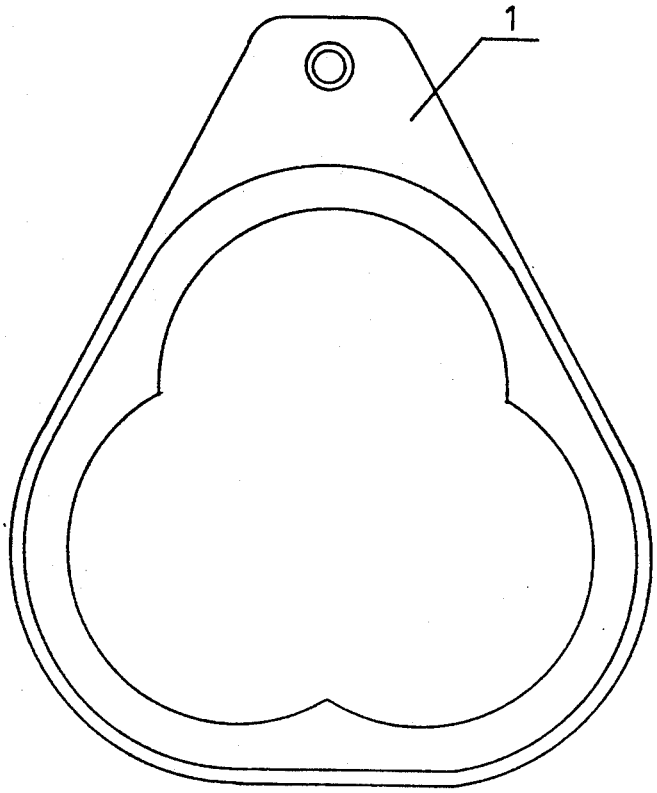
FIG. 2 is the top view of the casing of the logical mosaic-puzzle of FIG. 1.
Figure 3:
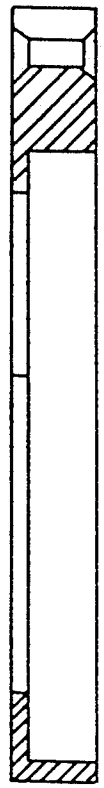
FIG. 3 is a sectional side-view of the casing as per FIG. 2.
Figure 4:
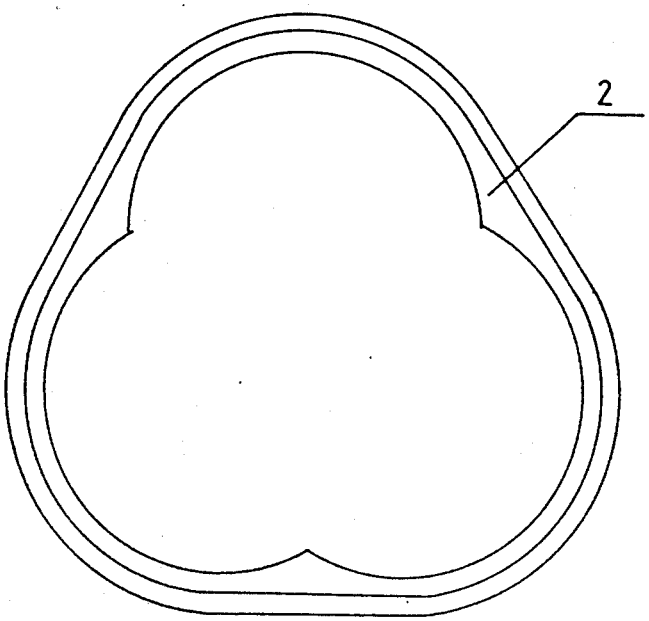
FIG. 4 is the top view of the clamping-frame shown on FIG. 1.
Figure 5:
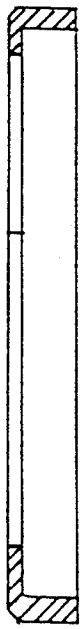
FIG. 5 is a sectional side-view of the clamping-frame of FIG. 4.
Figure 6:
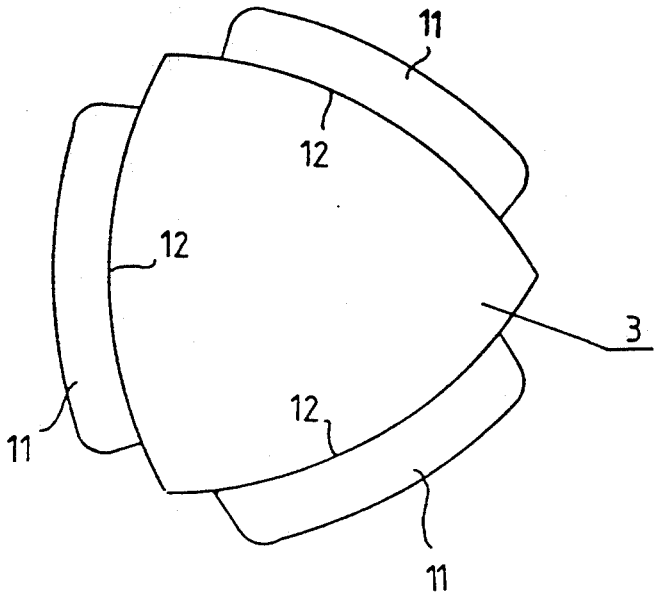
FIG. 6 is a top view of a puzzle-element taking part in the formation of the logical mosaic-puzzle as per FIG. 1.
Figure 7:
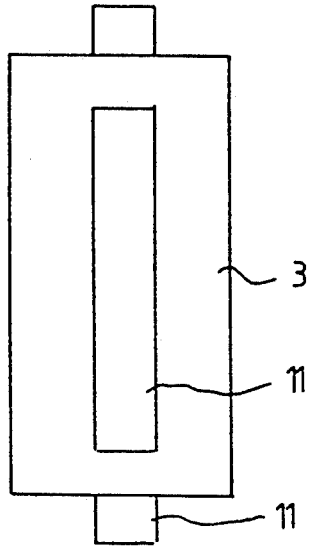
FIG. 7 is the side-view of the puzzle-element shown on FIG. 6.

In the general form of realization, in the starting position of the toy according to the invention (see FIG. 1) the puzzle-element (3) is arranged in the centre; its colouring corresponds to the colours of the clamping-frame (2) and the casing (1). A circle each (I, II, III) contains independently three puzzle-elements (4) of one type and one puzzle-element (5) of another type. As a matter of fact, due to overlapping, in respect to colours four elements each can be distinguished on each circle, three pieces of the type (4) and one piece of the type (5). Starting position: red: 4*a*, 5*a*; green 4*b*, 5*b*; blue 4*c*, 5*c*; yellow: elements 3, 2, 1. As a general approximation the aim of the game lies in to turn back the elements from any position into the original starting configuration, while obtaining any other configuration can be aimed at, too. Several possibilities of variation render the game increasingly exciting.

Figure 12:
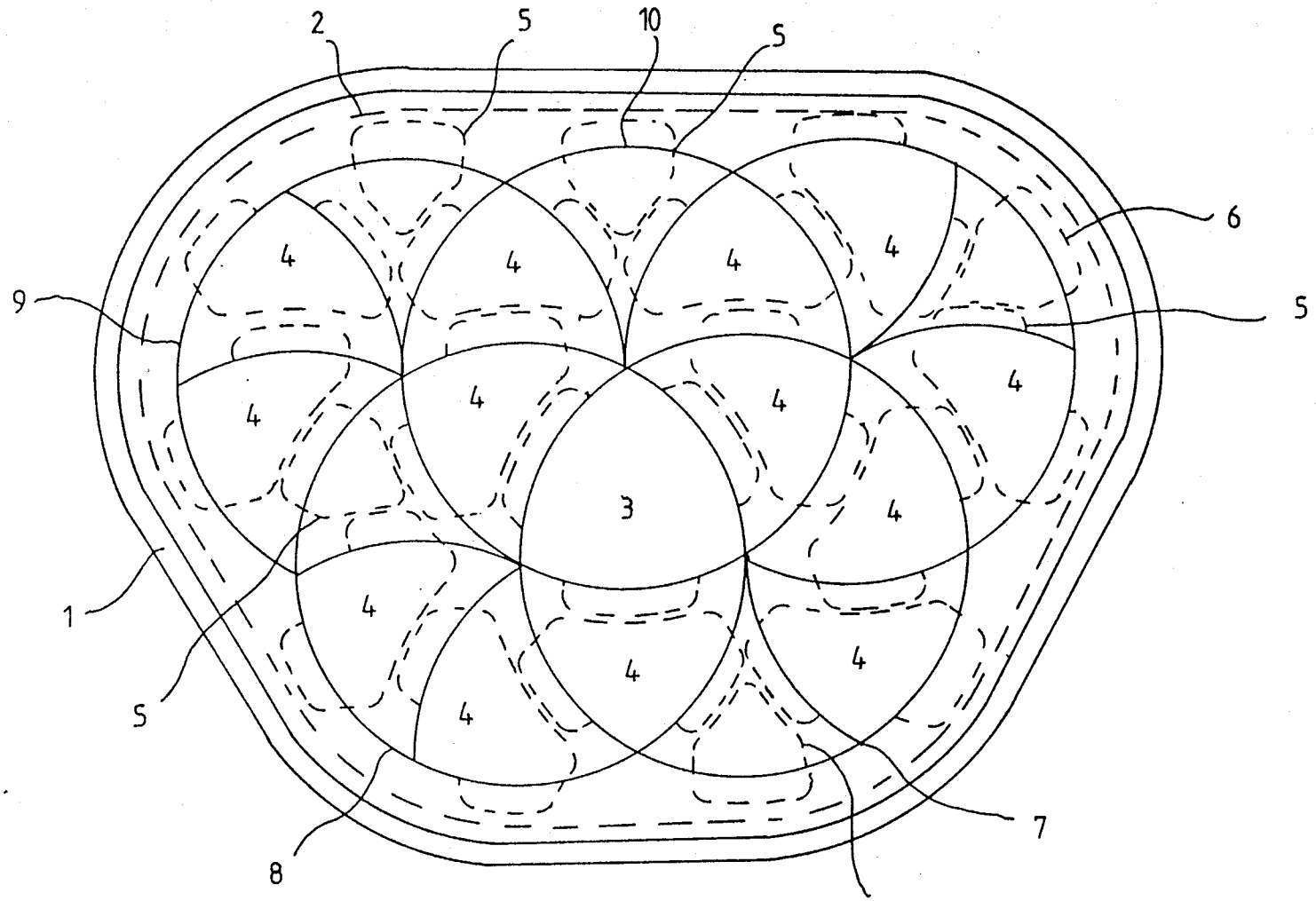
FIG. 12 is the top view of the embodiment with five circles of the logical mosaic-puzzle in accordance with the invention.

FIG. 12 shows an embodiment of the invention with five circles, where the number of the puzzle-elements (3), (4) and (5) is 19 and when inserting the clamping-frame (2) a groove will be formed between the casing (1) and the clamping-frame (2) which consist of the curved parts (6), (7), (8), (9) and (10).

In the general form of realization, in the starting position of the toy according to the invention the puzzle-element (3) is arranged in the centre; its colouring corresponds to the colours of the clamping-frame (2) and the casing (1). A central-circle each contains three puzzle-elements (4) of one type and one puzzle-element (5) of another type, while the further circles each contain two puzzle-elements (4) and one puzzle-element (5). As a matter of fact, due to overlapping, in respect to colours three-four elements each can be distinguished on each circle. As a general approximation the aim of the game lies in to turn back the elements from any position into the original starting configuration, while obtaining any other configuration can be aimed at, too. Several possibilities of variation render the game increasingly exciting.

Figure 13:
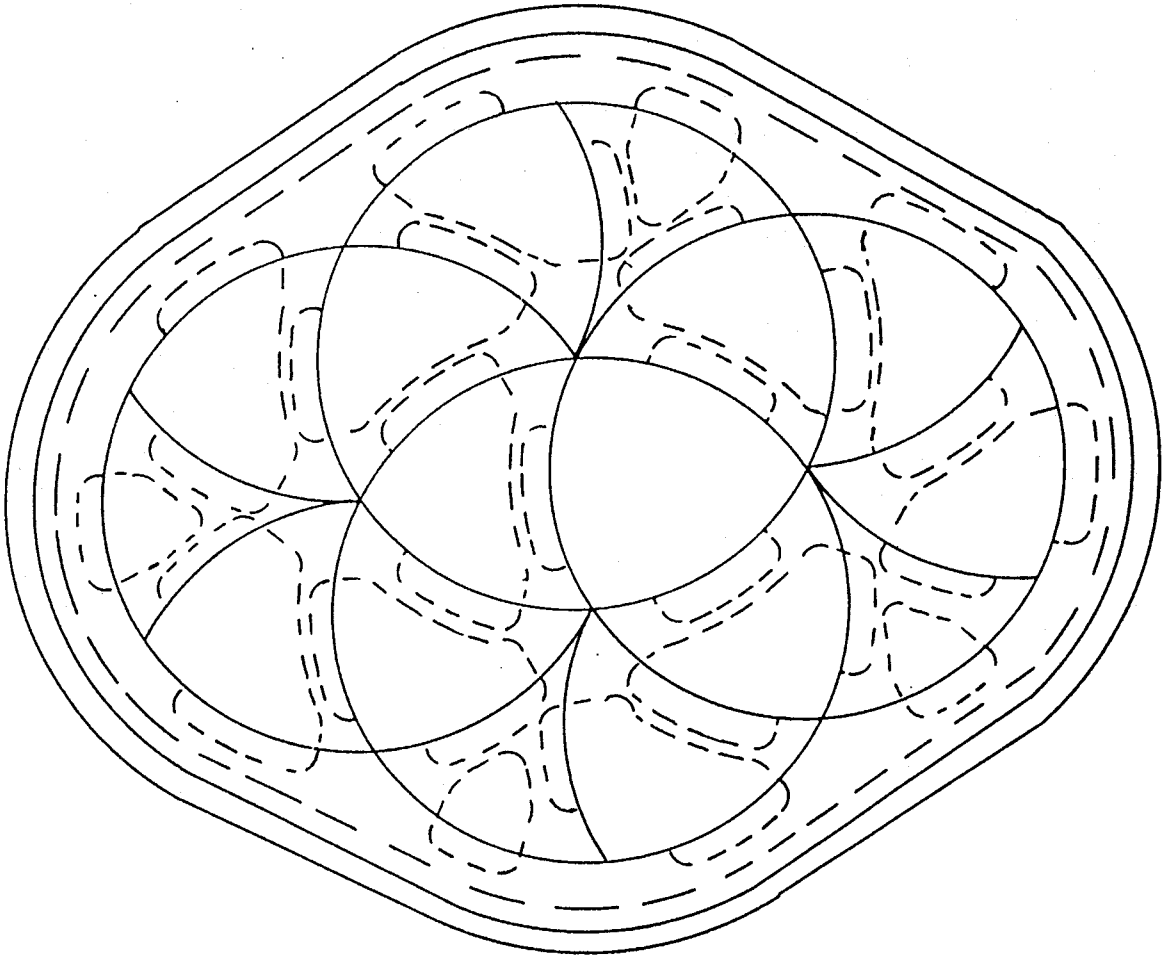
FIG. 13 is the top view of the embodiment with four circles of the logical mosaic-puzzle in accordance with the invention.

FIG. 13, shows an embodiment of the invention with four circles, where the number of the puzzle-elements (3), (4) and (5) is 16.

In the general form of realization, in the starting position of the toy according to the invention the puzzle-element (3) is arranged in the centre; its colouring corresponds to the colours of the clamping-frame (2) and the casing (1). A circle each contains three puzzle-elements (4) of one type and one puzzle-element (5) of another type, while the fourth circle contains two puzzle-elements (4) and one puzzle-element (5). As a matter of fact, due to overlapping, in respect to colours three-four elements each can be distinguished on each circle. As a general approximation the aim of the game lies in to turn back the elements from any position into the original starting configuration, while obtaining any other configuration render the game increasingly exciting. An additional advantage of the invention is, that the surfaces can be used for advertising purposes as well.

We claim:

1. Logical mosaic-puzzle comprising: mosaic toy-elements forming three groups, the toy-elements being arranged in a plurality of at least three circles overlapping one another, a frame surrounding the outer periphery of the circles and in engagement therewith, said frame consisting of an outer casing (1) and an inner clamping-frame (2) inserted in said casing to define a groove therebetween, said groove being in peripheral surrounding relation to said plurality of circles, said toy-elements (3, 4, 5) being connected to each other loosely for turning simultaneously on a plurality of said overlapping circles about the axis of the circles, said turning being restrained in said casing and clamping-frame only by engagement of the casing and clamping-frame with the outer periphery of said circles; the circles each consisting of six toy-elements (3, 4, 5), of which one toy-element (3) forms one of said groups and part of three overlapping circles while the overlapping circles are further formed of toy-elements (4, 5) arranged into two further groups, and which toy-elements (3, 4, 5) include projections (11, 15, 18) and grooves (19, 20, 21) with the projections of one toy-element extending into the groove of another toy-element and into the groove defined by the casing and clamping-frame to join the elements together and to the casing and clamping frame.

2. Logical mosaic-puzzle according to claim 1, including thirteen toy-elements (3, 4, 5) arranged into three different groups on three circles overlapping one another.

3. Logical mosaic-puzzle according to claim 1, including nineteen toy-elements (3, 4, 5) arranged into three different groups on five circles overlapping one another.

4. Logical mosaic-puzzle according to claim 1, including sixteen toy-elements (3, 4, 5) arranged into three different groups on four circles overlapping one another.

5. Logical mosaic-puzzle according to claim 1, wherein the toy-element (3) forming part of three overlapping circles is essentially a prism having the form of a regular arch-triangle surrounded by lateral arches (12), on each three sides of which a projection (11) is formed.

6. Logical mosaic-puzzle according to claim 5, wherein the toy-element (4) is arranged into a second group of elements joining the toy-element (3) and also forming part of overlapping circles, said toy-element (4) is essentially a prism having the form of an arch-triangle surrounded by two convex arch-sides (13) and a concave arch-side (14) joining these convex arch-sides (13), the convex arch-sides (13) of the prism being provided each with a projection (15) joining neighboring toy-elements (4, 5), and the concave arch-side (14) being provided with a groove (19) receiving the projections (11, 15) of neighboring toy-elements (3, 4).

7. Logical mosaic-puzzle according to claim 6, wherein the number of the toy-elements (4) arranged into the second group is nine.

8. Logical mosaic-puzzle according to claim 6, including thirteen toy-elements (4) forming the second group, which also take part in the formation of further circles and which join the toy-element (3) having a form of an arch triangle.

9. Logical mosaic-puzzle according to claim 6, including eleven toy-elements (4) forming the second group, which also take part in the formation of further circles and which join the toy-element (3) having a form of an arch triangle.

10. Logical mosaic-puzzle according to claim 6, wherein the toy-element (5) forming a third group of the toy-elements joining the toy-elements (4) and filling up free parts of the casing (1) and of the clamping-frame (2) and forming part of said overlapping circles, said toy-elements (5) being a prism having two concave arch-sides (17) and a convex arch-side (16) joining the concave arch-sides, the convex arch-side (16) of the prism is being provided with a projection (18) extending into the groove of the casing (1) and the clamping-frame (2) while the concave arch-sides (17) are provided each with grooves (20, 21) taking up the projections (15) of thee neighboring elements (4).

11. Logical mosaic-puzzle according to claim 10, including three toy-elements (5) forming the third group.

12. Logical mosaic-puzzle according to claim 10, including five toy-elements (5) forming the third group.

13. Logical mosaic-puzzle according to claim 10, including four toy-elements (5) forming the third group.

14. Logical mosaic-puzzle according to claim 10, wherein visible surfaces of the toy-elements (3, 4, 5) are provided with distinguishing colors or other markings.

15. Logical mosaic-puzzle according to claim 1, wherein two sides of the toy-elements are accessible whereby turning of different toy-elements (3, 4, 5) included in the casing (1) and the clamping-frame (2) can take place simulaneously from said two sides, as a consequence of which the planar characteristics of the toy change into a solid.

16. Logical mosaic-puzzle according to claim 1 wherein the casing (1) and clamping-frame (2) when assembled together define an opening therethrough, which opening exposes opposite sides of said toy-elements.

* * * * *